US005890714A

United States Patent [19]

Brooks et al.

[11] Patent Number: 5,890,714

[45] Date of Patent: Apr. 6, 1999

[54] ACCESSIBLE COPY SHEET TRANSPORT WITH SIDE GUIDES

[75] Inventors: Daniel W. Brooks, Marion; Richard E. Smith, Fairport, both of N.Y.

[73] Assignee: Xerox Corporation, Stamford, Conn.

[21] Appl. No.: 786,008

[22] Filed: Jan. 21, 1997

[51] Int. Cl.[6] ..... B65H 9/00

[52] U.S. Cl. ..... 271/240; 271/273; 271/275; 399/388

[58] Field of Search ..... 271/240, 272, 271/273, 274, 275; 399/388

[56] References Cited

U.S. PATENT DOCUMENTS

| | | | |
|---|---|---|---|
| 4,163,550 | 8/1979 | Armstrong | 271/274 |
| 4,369,959 | 1/1983 | Hornbuckle | 271/274 |
| 4,523,832 | 6/1985 | Strutt et al. | 355/3 SH |
| 4,533,135 | 8/1985 | Barker | 271/275 |
| 4,607,837 | 8/1986 | Pierce | 271/273 |
| 5,091,754 | 2/1992 | Abe et al. | 271/240 |
| 5,098,081 | 3/1992 | DeFigueiredo | 271/240 |
| 5,209,467 | 5/1993 | Schmaling | 271/240 |
| 5,765,090 | 6/1998 | DiCesate | 271/275 |

OTHER PUBLICATIONS

Xerox Disclosure Journal, vol. 4, Jul./Aug. 1979, p. 467.

*Primary Examiner*—H. Grant Skaggs
*Attorney, Agent, or Firm*—William A. Henry, II

[57] ABSTRACT

A baffleless, easily accessible, copy sheet transport apparatus without sheet baffles that enables viewing and accessing jammed sheets without opening any baffles. The transport includes a pulley driven narrow timing belt with biased idler rolls providing normal force on belt driven copy sheets. Unobstructive copy sheet side guides are included to enhance viewing and removal of copy sheets from the copy sheet transport.

3 Claims, 3 Drawing Sheets

ACCESSIBLE COPY SHEET TRANSPORT WITH SIDE GUIDES

CROSS REFERENCE TO RELATED APPLICATIONS

Cross reference is hereby made to copending and commonly assigned U.S. patent application Ser. No. 08/785,111, (D/96430) concurrently filed on Jan. 21, 1997 and entitled ACCESSIBLE COPY SHEET TRANSPORT by Cesidio J. DiCesare and now U.S. Pat. No. 5,765,098.

BACKGROUND OF THE INVENTION

1. Field of the Invention

This invention relates to copy sheet transport systems, and more particularly, to an improved easily accessible transport for copy sheets transported in a copier/printer.

2. Description of the Prior Art

In copier/printer machines, it is common to transport sheets from sheet feeders to a photoconductor by means of a multiple roll transport. A copy sheet transport is typically comprised of a series of roll nips such that single sheets are under the control of the roll nips at all times prior to exiting the copier/printer and constrained on both sides of the sheet by full width metal or plastic paper guides or baffles that physically surround the sheet and typically inhibits visual and/or physical access to the sheet in the event of an unplanned shutdown, such as, a sheet jam.

A typical copy sheet transport assembly that is used to transport copy sheets between a paper feeder and a photoreceptor of an electrophotographic apparatus is disclosed in Vol. 4, Number 4, July/August 1979, pg. 467 of the Xerox Disclosure Journal. The sheet transport assembly includes a baffle member adapted to an appropriate configuration generally curved or otherwise in combination with one or more fabric belts routed over the outside of the baffle with the substrate path being provided by the belt(s) and baffle. The belt is made with woven Nylon fabric material and rubber covered on the side which does not contact the substrate. A substrate is introduced between the belt and baffle and is reliably and economically transported without the use of vacuum or multiple pinch roller systems.

In U.S. Pat. No. 4,523,832 a sheet transport apparatus is shown for a photocopier for reversing the direction of sheet travel and has only an outer curved guide surface, an input, intermediate and output drive rolls spaced apart less than the length of a sheet. The output drive rolls are disengagable and cooperate with an opposed guide surface and one or more retractable stops to achieve registration of the copy sheet with an image.

A jammed sheet removal aid in a reproduction machine is disclosed in U.S. Pat. No. 4,533,135. A display on the reproduction machine indicates to an operator when a jam occurs. In response to the occurrence of a jam, all of the sheets in the processor of the reproduction machine are automatically freed from their respective sheet transports. In this way, the operator may readily remove the jammed sheet from the respective transport.

SUMMARY OF THE INVENTION

Accordingly, an operator accessible, baffeless, copy sheet transport apparatus that increases the latitude of copy sheet removal from the paper path of a copier/printer is disclosed which includes at least one narrow timing belt entrained around a drive pulley at one end and captured in place by an idler pulley at the other end. Normal force is provided by spring biased idler rollers. The narrowness of the timing belt allows the operator in case of a jam to see the copy sheet(s) that need to be removed and provides relatively uninhibited hand access for removing the copy sheet(s). C-shaped copy sheet side guides are included to constrain edges of the copy sheets while simultaneously allowing viewing and enhanced access to the copy sheets.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

The invention will now be described by reference to a preferred embodiment of the prefuser vacuum transport system of the present invention preferably for use in a conventional copier/printer. However, it should be understood that the sheet vacuum transport method and apparatus of the present invention could be used with any machine environment in which transport of sheets is desired.

Figure 3:
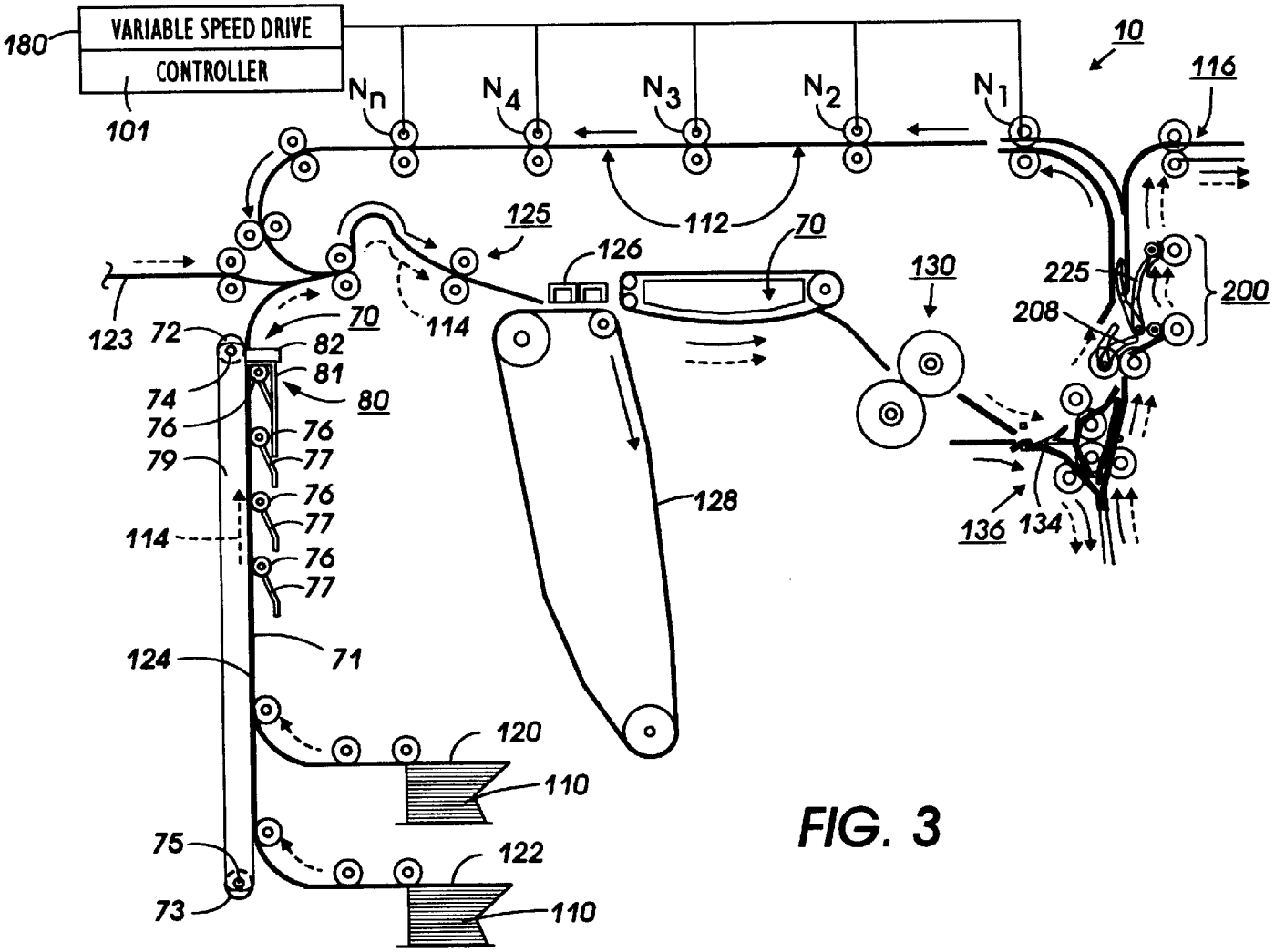
FIG. 3 is an side view of an illustrative printing machine incorporating the accessible copy sheet transport apparatus of the present invention.

For a general understanding of the features of the present invention, reference is made to the drawings. In the drawings like reference numerals have been used throughout to designate identical elements. FIG. 3 schematically depicts the various components of an illustrative electrophotographic printing machine incorporating the prefuser vacuum transport apparatus of the present invention therein.

Describing first in further detail the exemplary printer embodiment with reference to FIG. 3, there is shown a duplex laser printer 10 by way of example of automatic electrostatographic reproducing machines of a type like that of the existing commercial Xerox Corporation "DocuTech" printer shown and described in U.S. Pat. No. 5,095,342 suitable to utilize the vacuum transport system of the present invention. Although the disclosed method and apparatus is particularly well adapted for use in such digital printers, it will be evident from the following description that it is not limited in application to any particular printer embodiment. While the machine 10 exemplified here is a xerographic laser printer, a wide variety of other printing systems with other types of reproducing machines may utilize the disclosed prefuser vacuum transport system.

Turning now more specifically to this FIG. 3 system 10, the photoreceptor is 128, the clean sheets 110 are in paper trays 120 and 122 (with an optional high capacity input path 123), the vertical sheet input transport is 124, image transfer is at 126, fusing at 130, inverting at 136 selected by gate 134, decurling at 200 with the use of gates 208 and 225, etc. There is an overhead duplex loop path 112 with plural variable speed feed rollers $N_1$–$N_n$ providing the majority of the duplex path 112 length and providing the duplex path sheet feeding nips; all driven by a variable speed drive 180 controlled by the controller 101. This is a top transfer (face down) system. Gate 208 selects between output 116 and dedicated duplex return loop 112 here.

In this FIG. 3 embodiment, the endless loop duplex (second side) paper path 112 through which a sheet travels during duplex imaging is illustrated by the arrowed solid lines, whereas the simplex path 114 through which a sheet to be simplexed is imaged is illustrated by the arrowed broken lines. Note, however, that the output path 116 and certain other parts of the duplex path 112 are shared by both duplex sheets and simplex sheets, as will be described. These paths are also shown with dashed-line arrows, as are the common input or "clean" sheet paths from the paper trays 120 or 122.

After a "clean" sheet is supplied from one of the regular paper feed trays 120 or 122 in FIG. 3, the sheet is conveyed by vertical transport 124 and registration transport 125 past image transfer station 126 to receive an image from photoreceptor 128. The sheet then passes through fuser 130 where the image is permanently fixed or fused to the sheet. After passing through the fuser, a gate 134 either allows the sheet to move directly via output 116 to a finisher or stacker, or deflects the sheet into the duplex path 112, specifically, first into single sheet inverter 136 here. That is, if the sheet is either a simplex sheet, or a completed duplex sheet having both side one and side two images formed thereon, the sheet will be conveyed via gate 134, gate 208 and gate 225 directly to output 116. However, if the sheet is being duplexed and is then only printed with a side one image, the gate 134 will be positioned by a sensor (not shown) and controller 101 to deflect that sheet into the inverter 136 of the duplex loop path 112, where that sheet will be inverted and then fed to sheet transports 112 and 125 for recirculation back through transfer station 126 and fuser 130 for receiving and permanently fixing the side two image to the backside of that duplex sheet, before it exits via exit path 116. All of the sheets pass through decurler 200.

Figure 1:
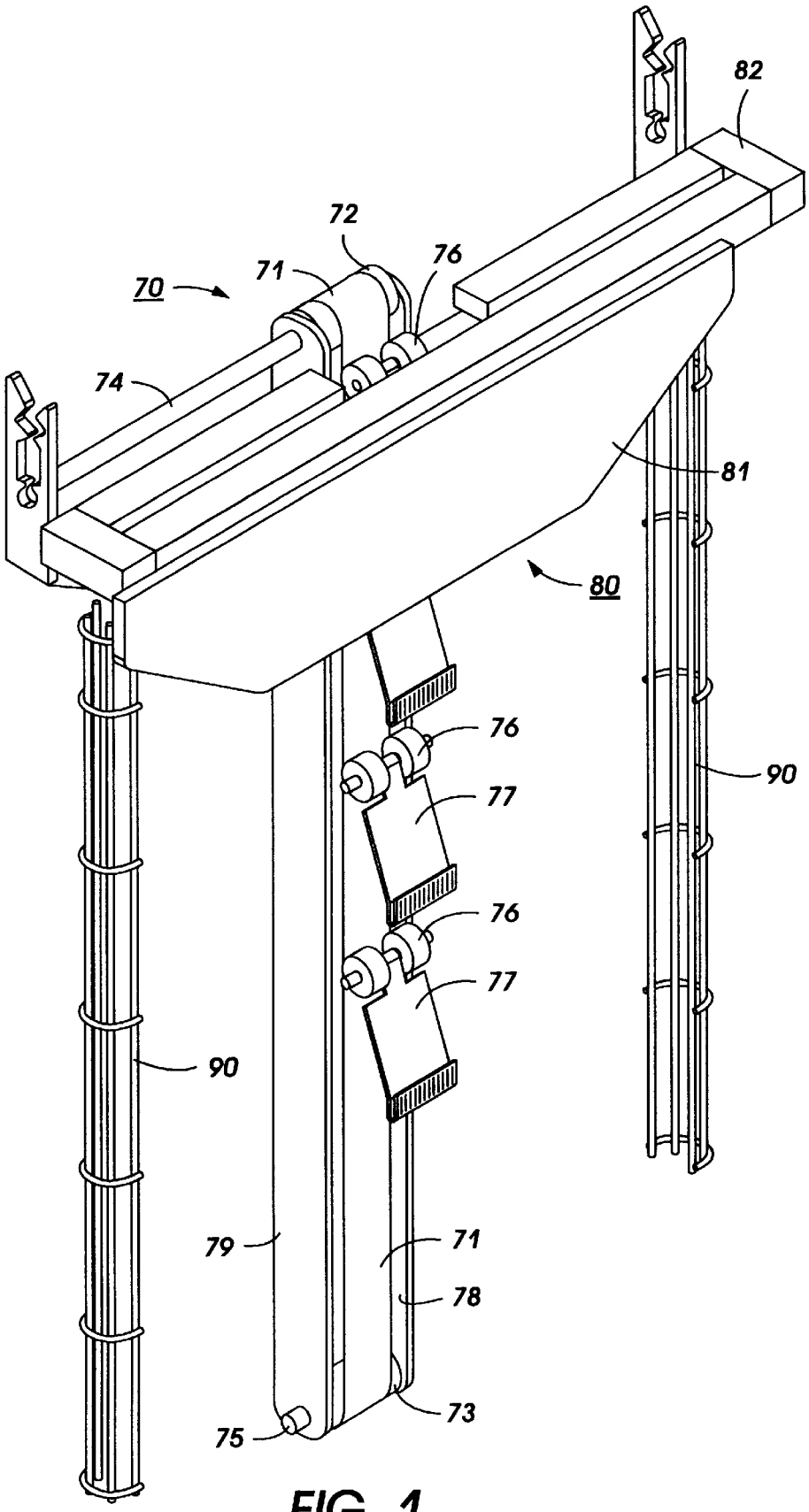
FIG. 1 is a perspective of the easily accessible copy sheet transport apparatus shown in FIG. 3 showing wire form copy sheet side guides.
Figure 2:
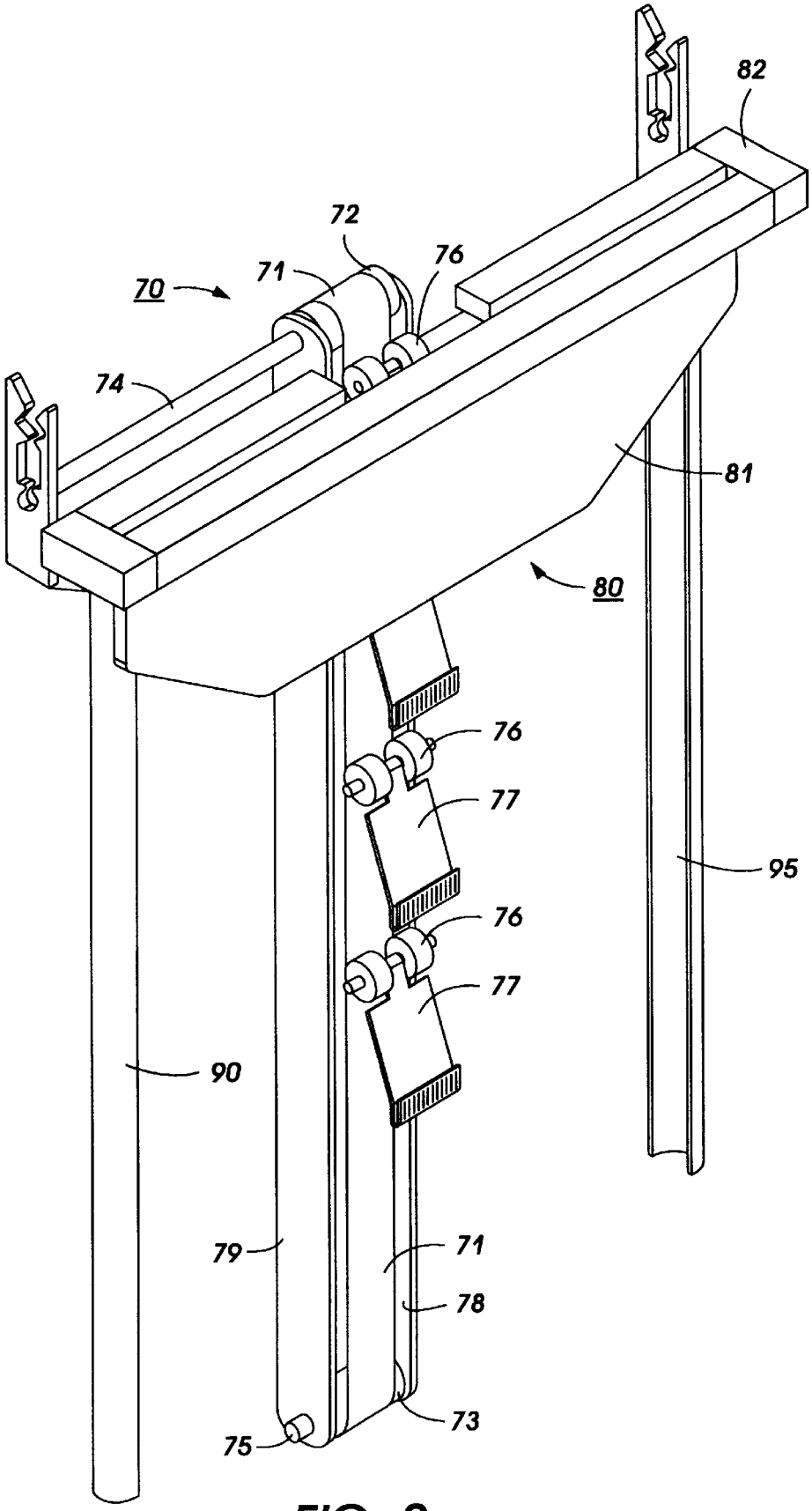
FIG. 2 is a perspective of an alternative embodiment of the easily accessible copy sheet transport apparatus of the present invention showing a solid C-shaped member for constraining only copy sheet edges.

In accordance with the present invention, as more specifically shown in FIGS. 1 and 2, a baffleless, T-shaped, operator accessible, copy sheet transport 70 adapted to transport copy sheets either horizontally or vertically is disclosed as comprising a 25 mm wide neoprene timing belt 71 that is entrained around drive pulley 72 and idler pulley 73, mounted on rotatable shafts 74 and 75, respectively. Drive pulley 72 is mounted for rotation by shaft 74 in a counterclockwise direction in order to drive sheets in the direction of transfer station 126. A conventional machine drive mechanism is connected to shaft 74 and controlled by controller 101. Timing belt 71 and driving and idler pulleys 72 and 73 are mounted on a frame members 78 and 79 which in turn are mounted on support structure 80, all of which are preferably made of plastic. Support structure 80 includes a member 81 parallel to and above timing belt 71 and a member 82 that is orthogonal to member 81 having a support bracket therein in which shaft 74 is mounted. Normal force is provided by idler rolls 76 attached to flat springs 77 mounted to a frame (not shown) that is fastened to a transport frame (not shown) which makes up the vertical transport assembly of copier/printer 10.

Advantages of the baffleless, operator accessible, copy sheet transport of FIGS. 1 and 2 include a reduced number of parts over conventional copy sheet transports, low cost, high reliability, easy jam clearance, low torque, less power required to drive the timing belt 71, and the elimination of the need for baffles. Low timing belt tension can be employed since timing belt teeth are used between the drive pulley 72 and timing belt 71. This reduced belt tension results in less power required to drive the transport which is very critical to machines of middle volume copy bands. Copy sheet transport 70 minimizes the area of paper guides covering the copy sheets in transit to reduce cost and improves both visual and physical access to the sheets in the unlikely event of a jams which must be cleared by an operator. It addresses the two most important aspects of jam clearance which are: (1) seeing the copy sheets that need to be removed; and (2) providing relatively uninhibited hand access for removing the sheet or sheets.

In the embodiment of the present invention in FIG. 1, instead of full width metal or plastic guides surrounding copy sheets, a C-shaped wire form 90 loosely constrains and protects outboard and inboard edges of copy sheets as they are conveyed by copy sheet transport system 70 while simultaneously allowing an operator clear viewing and ready access to the copy sheets in the event of a jam without opening a baffle. Instead of wire forms 90, copy sheet edge guides 95 can be made of molded plastic as shown in FIG. 2 and can be used for horizontal and vertical transports. If desired, for vertical transports, weighted flexible Mylar strips could be used instead of the wire forms.

It should now be apparent that an accessible copy sheet transport has been disclosed that includes a narrow timing belt that is rotated by a drive roll to transport copy sheets in a given direction. Spring biased idler rolls hold the copy sheets on the outer surface of the timing belt, thus ensuring easy viewing and access to the copy sheets, if necessary.

While the embodiment shown herein is preferred, it will be appreciated that it is merely one example, and that various alterations, modifications, variations or improvements thereon may be made by those skilled in the art from this teaching, which is intended to be encompassed by the following claims:

What is claimed is:

1. A copier/printer including a photoreceptor having page images thereon, copy sheets for receiving the page images from the photoreceptor, a transfer apparatus for transferring the page images from the photoreceptor to the copy sheets, a fuser for fusing the page images to the copy sheets, and a baffleless, easily accessible copy sheet transport for transporting the copy sheets to the transfer apparatus, comprising:

a drive pulley;

an idler pulley;

a timing belt entrained around said drive and idler pulleys for transporting copy sheets in a predetermined direction;

a member positioned to apply a normal force to copy sheets as they are transported by said timing belt; and C-shaped, fixedly positioned, sided guides positioned at opposite sides of and removed from said timing belt of said baffeless, easily accessible copy sheet transport, said C-shaped side guides loosely constraining and protecting outboard and inboard edges of copy sheets as they are conveyed by said timing belt and enabling an operator of the copier/printer to be able to see the copy sheets at all times and have unencumbered access to the copy sheets in the event of a copy sheet jam.

2. The copy sheet transport of claim 1, wherein said C-shaped side guides are wire forms.

3. The copy sheet transport of claim 1, wherein said C-shaped side guides are made of plastic.

* * * * *